United States Patent [19]

Fessler

[11] 4,198,083

[45] Apr. 15, 1980

[54] FASTENER LATCH

[75] Inventor: Herman S. Fessler, Coon Rapids, Minn.

[73] Assignee: The Cornelius Company, Anoka, Minn.

[21] Appl. No.: 895,095

[22] Filed: Apr. 10, 1978

[51] Int. Cl.[2] ..... E05C 3/04

[52] U.S. Cl. ..... 292/205

[58] Field of Search ..... 292/202, 205, 213, 218, 292/244, 104, 116, 120, DIG. 68, 281

[56] References Cited

U.S. PATENT DOCUMENTS

| | | | |
|---|---|---|---|
| 388,002 | 8/1888 | Selle | 292/202 |
| 1,312,931 | 8/1919 | Tenny et al. | 292/205 |
| 1,588,163 | 6/1926 | Brownlow | 292/202 |
| 2,007,065 | 7/1935 | Walker | 292/205 X |
| 2,715,897 | 8/1955 | Newland et al. | 292/202 X |

*Primary Examiner*—Richard E. Moore

*Attorney, Agent, or Firm*—Henry C. Kovar

[57] ABSTRACT

A latch has a central C-shaped clamping member with a latching slot therein, to each side of the clamping member is a handle, and a flange having an aperture for rotatable journaling of the latch; the latch is symmetrical about the centerline of the clamping member and is formed of a contiguous piece of sheet metal with the clamping member being two layers of metal folded against each other; a latch mechanism utilizing this latch has two discrete structure members, a pair of apertures in each structure member, a pin rotatably fastening the latch to one aperture, a pilot on the pin with the pilot being registrable with a corresponding aperture on the other structure, the pilot and pin are interchangeable in either aperature enabling journaling of the latch from either end, the swinging end of the latch can be locked by placement of a lock pin in the otherwise unused latch journal and structure member apertures, and there is a guide ramp on either side of the clamping member for guiding the structure members together.

33 Claims, 12 Drawing Figures

FIG.4
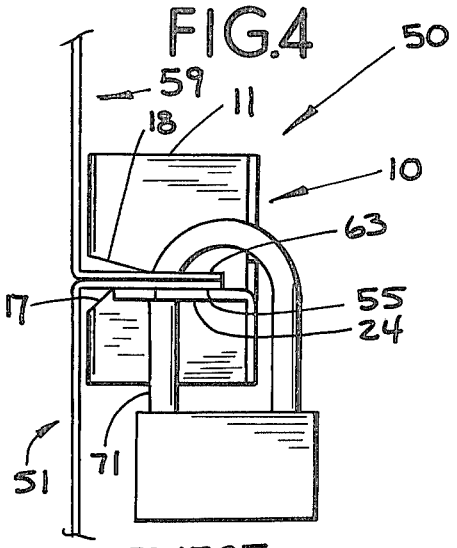
FIG.5
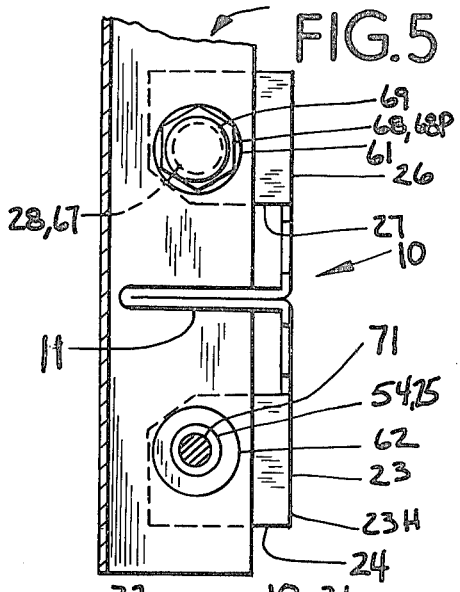
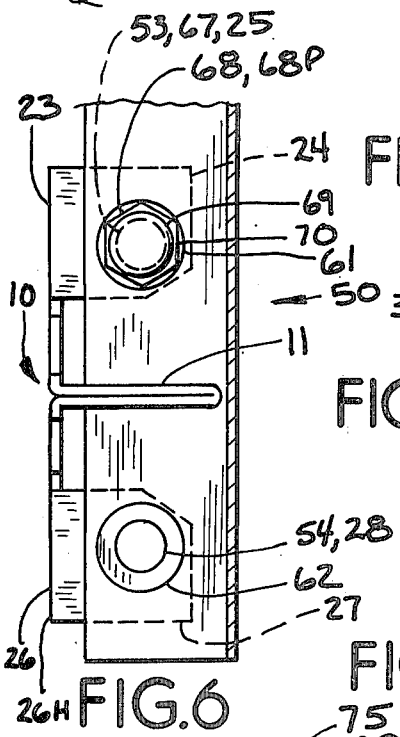
FIG.6
FIG.8
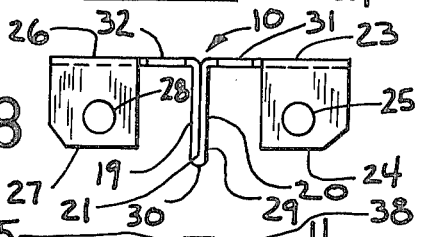
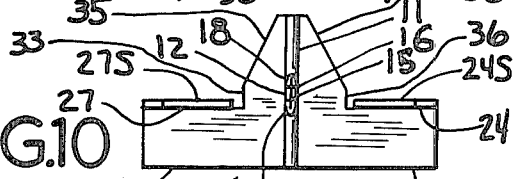
FIG.10
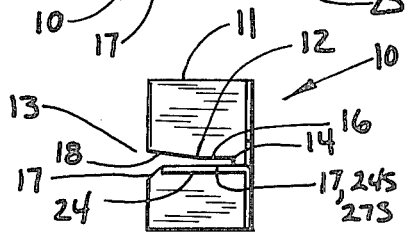
FIG.9
FIG.7
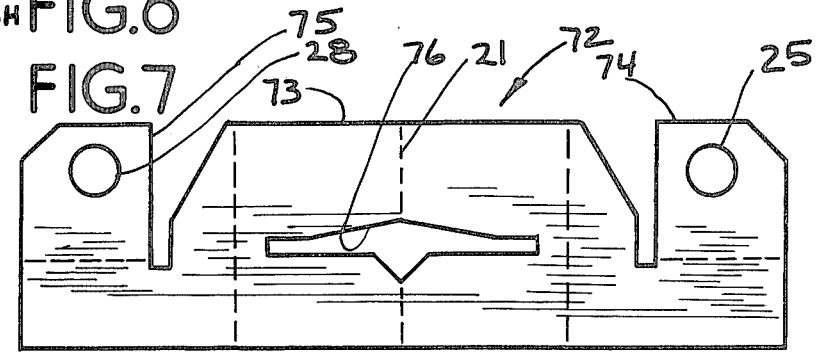

FASTENER LATCH

BACKGROUND OF THE INVENTION

1. Field of the Invention

This invention pertains to a manually operable latch having a clamping member, and to a latch mechanism for clamping two discrete structure members together.

2. Prior Art

No particular prior art patents are known, but the field of latch type structures is quite developed with there being an extensive quantity of types known. The previously known latching mechanisms usually require some type of special sheet metal for their usage, special fastening provision and lock apertures and the like, tools are required, linkage mechanisms are used, and loose parts, i.e. pins, bolts, nuts and screws, are objectionable.

Various criterion for latches and latch mechanisms have been well defined; latches must hold two or more elements together, are usually special purpose devices specifically for a particular piece of equipment, should positively secure, should be rattle-free, should prevent access, should have maximum strength and minimum operating force, should be of minimum size and require no special materials.

Latches and latching mechanisms are generally more complicated, more expensive and take much more structure than simple fasteners such as bolts and nuts.

OBJECTS OF THE PRESENT INVENTION

It is an object of the present invention to provide a latch for clamping two discrete structures together.

It is an object of the present invention to provide a latch formed of a contiguous piece of metal.

It is an object of the present invention to provide a latch that can be rotatably mounted on either end of itself.

It is an object of the present invention to provide a T-shaped latch having a clamping member in the central leg of the T-shape and a mounting journal in one of the side arms of the T-shape.

It is an object of the present invention to provide a latch mechanism having a pilot for aligning two structures, and a clamp type latch for securing the structures together.

It is an object of the present invention to provide a latch mechanism having pairs of matching apertures in securable structures, a latch positioned between the apertures, and a mounting pin for mounting the latch to either side of the aperture on one of the structures.

SUMMARY OF THE INVENTION

A fastener latch for securing two structure members together has a C-shaped clamping member having an open ended latching slot, a mounting journal to one side of the clamping member, and a manually manipulatable handle for rotation of the latch around the journal; a latching mechanism has this latch, a pilot for positioning two structures to each other, and may have a pair of matching apertures in each structure member with the latch being rotatably mountable to either aperture of one of the structure members.

ON THE DRAWINGS

FIG. 4 is an elevational end view, in partial section, of the structure of FIG. 3 in a secured together position;

FIG. 5 is a top plan view of the structure of FIG. 4;

FIG. 6 is a top plan view of the structure of FIG. 5, in which mounting of the latch to the structure is reversed end for end;

FIG. 7 is a top plan view of a sheet metal blank for the latch of FIG. 1;

FIG. 8 is a top plan view of the latch of FIG. 1;

FIG. 9 is an end view of the structure of FIG. 8;

FIG. 10 is a front elevational view of the latch of FIG. 9;

AS SHOWN ON THE DRAWINGS

Figure 1:
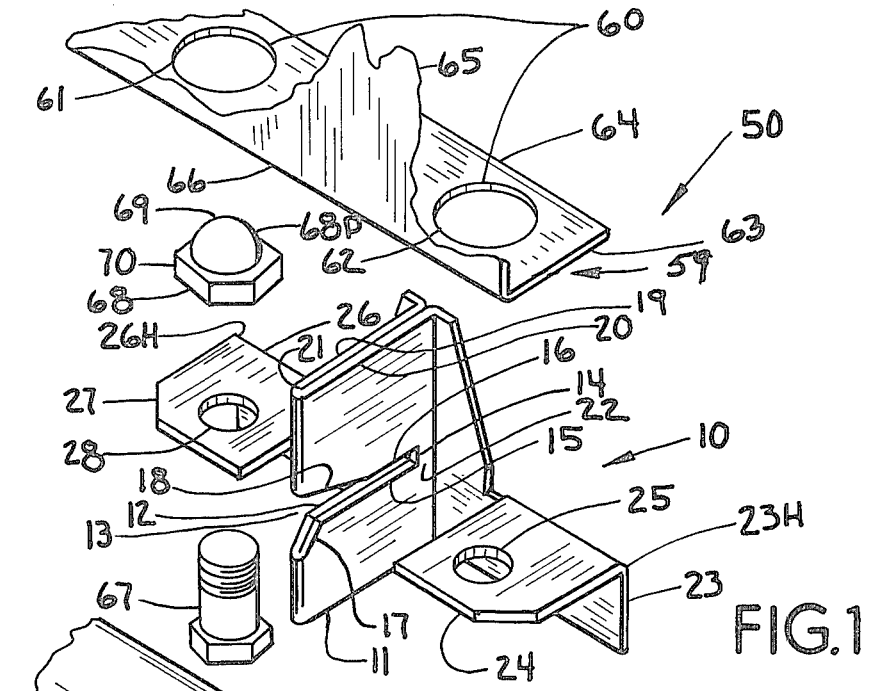
FIG. 1 is an exploded perspective view of the preferred embodiment of a latch and a latch mechanism provided in accordance with the principles of the present invention.

The principles of the present invention are particularly useful when embodied in a fastener latch of the type illustrated in FIG. 1 and generally indicated by the numeral 10, and in a latch mechanism of the type also illustrated in FIG. 1 and generally indicated by the numeral 50.

The latch 10 has a C-shaped clamping member 11 which has a latching slot 12. The latching slot 12 has an open end 13, a closed end 14, a first or lower clamp surface 15 and a second or upper clamp surface 16. The lower clamp surface 15 has an entry cam 17 at about a forty-five degree angle and the upper clamp surface 16 has a clamping entry cam 18 at an angle of about fifteen degrees. The entry angle of cam 17 is therefore greater than the entry angle of cam 18.

The latch 10 is preferably formed from a contiguous piece of sheet metal and the clamping member 11 is formed of two layers of sheet metal. A first layer 19 of sheet metal is complemented by a second layer 20 of sheet metal which is turned over one hundred and eighty degrees around a fold line 21 and preferably flattened against the first layer 19. Each of the sheet metal layers 19, 20 has an identical profile of the latching slot 12 and behind the latching slot closed end 14, each sheet metal layer has a base section 22.

A side extension 23 extends to a first side of the clamping member 11 and forms a handle 23H. The side extension 23 includes a flange 24 which has an aperture forming a journal 25. A second side extension 26 extends to a second and opposite side of the clamping member 11 and forms a second handle 26H. The second side extension has a flange 27 which has an aperture forming a second journal 28.

The latch 10 as seen from above as in FIG. 8 is in the shape of a "T" with the clamping member forming a central leg 29 and with the latching slot open end 13 being at a distal end 30 of the central leg 29 of the T-shape. The latching slot open end 13 is centered in and about the fold line 21 between the first and second layers 19, 20 of sheet metal. The first side extension 23 forms a first arm 31 of the T-shape and the second side extension 26 forms a second arm 32 of the T-shape. The latch 10 is substantially symmetrical about its centerline, specifically to each side of central leg 29 of the T-shape and to each side of the center between the first and second layers 19, 20 of sheet metal forming the clamping member 11.

The flanges 24, 27 and axis of the journals 25, 28 lie in a plane perpendicular to the plane of the clamping member 11 as best seen in FIG. 10, and the flanges 24, 27 lie in a plane parallel to the plane of the latching slot 12. The flanges 24, 27 each have an upper surface 24S, 27S respectively, which lie substantially in the same plane as does the latching slot lower clamp surface 15 and as such, the surfaces 24S, 27S, 15 are all coplanar.

The latching mechanism 50 includes the latch 10 and two discrete structure members securable together by the latch 10. A first and lower structure member 51 has a first pair of apertures 52 which include a rear aperture 53 and a front aperture 54, both of which are the same size. The apertures 53, 54 are in a structural flange 55 having an interior edge 56. The flange 55 depends from a sheet metal panel 57 and is formed about an exterior edge 58. A second structure member 59 has a second pair of apertures 60 which include a rear aperture 61 and a front aperture 62, both of the same size. The apertures 61, 62 are in a structural flange 63 having an interior edge 64. The flange 63 depends from a second sheet metal panel 65 and is formed about an exterior edge 66.

The first apertures 53, 54 register and align with the second apertures 61, 62 when the first and second structure members 51, 54 are against each other. The apertures 53, 54, 61, 62 are all spaced the same distance from flange internal edges 56, 64 respectively. The first apertures 53, 54 are preferably smaller in size than the second apertures 61, 62.

A pin 67 mounted through one of the journals 25, 28 and one of the first apertures 53, 54 provides a shaft and an axis about which the latch 10 is rotatable. The pin 67 is fastened to the first structure member 51 and is held in place in one of the apertures 53, 54 by a fastener nut 68. The fastener nut 68 also serves as a pilot 68P and is preferably an acorn nut having a tapered top 69 and a wrenching section 70. The second apertures 61, 62 are sized to precisely fit about the wrenching section 70 of the pilot 68P, and the tapered top 69 serves as a guiding member to locate one of the second apertures 61, 62 precisely upon the pilot 68P.

A lock pin 71 may be placed in the otherwise unused journal and aperture as is shown in FIGS. 4 and 5 for locking the latch 10 in a secured position from which the latch 10 cannot be released.

A contiguous sheet metal blank 72 for being formed into the latch 10 is illustrated in FIG. 7. The blank 72 includes a center section 73 to be formed into the clamping member 11, a pair of end ears 74, 75 to be formed into the handle side extensions 23, 26, a pair of round apertures for the journals 25, 28 and an irregular aperture 76 centered on the fold line 21 and which will become the latching slot 12. The blank 72 is pierced from a strip of continuous and constant width sheet metal (not shown) and the width of the center section 73 and the end ears 74, 75 is identical which most efficiently utilizes the strip metal. In FIG. 7 the bend lines are shown in dotted line. In fabrication of the latch 10, a continuous strip constant width sheet metal is fed into a stamping die. The blank 72 is pierced, the flanges 24, 27 are formed, the side extensions 23, 26 are formed and then the clamp member is folded over on the center fold line 21 and the first and second sheet metal layers 19, 20 are flattened together. The latch 10 is then completely fabricated and ready for assembly into a structure.

The latch 10 is used to secure two or more discrete structure members together and provides rapid and easy unfastening so that the structure members can be removed from one another. The latch 10 is ideal for cabinet structures on sheet metal cabinets such as those used for air conditioners, vending machines, electric component cabinets and appliances. A specific usage of this latch 10 is disclosed in my co-pending application Ser. No. 895,096, filed on Apr. 10, 1978, and titled "Beverage Dispensing Machine and Cabinet Therefor." The latch 10 contributes to improved access and serviceability for the components of the beverage dispensing machine and for repair of cabinetry.

Figure 2:
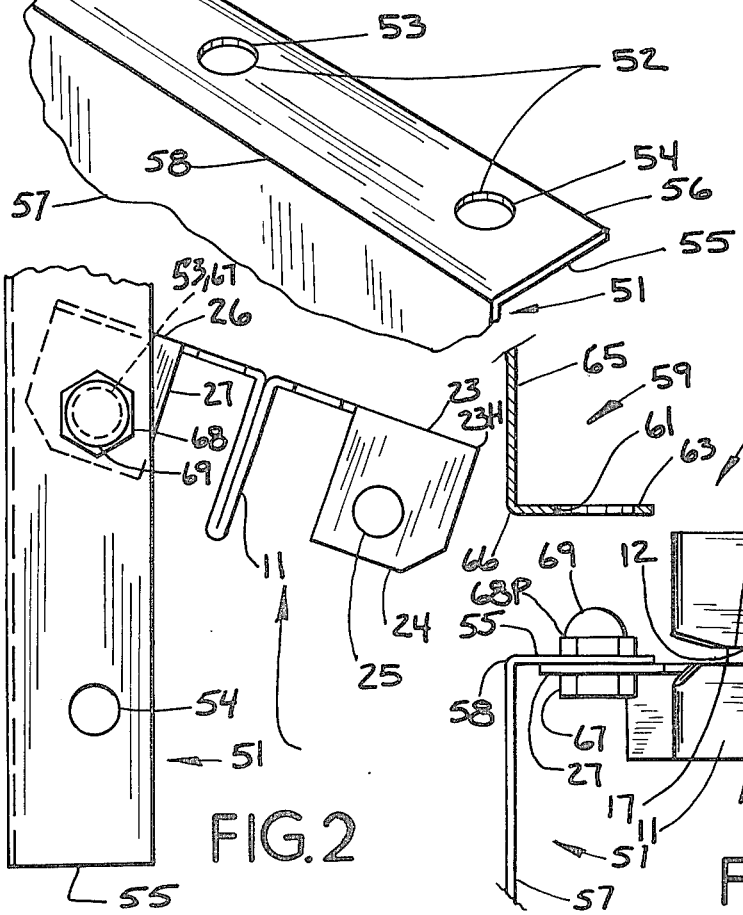
FIG. 2 is a top plan view of the structure of FIG. 1.
Figure 3:
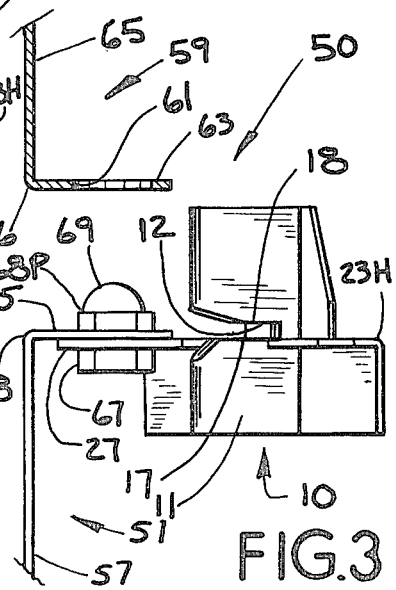
FIG. 3 is an elevational end view, in partial section, of the structure of FIG. 2.

The two structure members 51, 59 to be secured together are usually provided as part of larger discrete cabinetry components. The latch 10 is mounted to the first structure member 51 inserting the pin 67 through the latch journal 28 and the first structure rear aperture 53 and then fastening the pin 67 with its fastener nut 68 as is shown in FIGS. 2, 3 and 5. The second structure member 59 is placed against the first structure member 51 and the second structure rear aperture 61 finds the tapered top 69 of the fastener nut 68 and is guided down and piloted on to the wrenching section 70. The second structure front aperture 62 is then aligned with the first structure front aperture 54. The flanges 55, 63 are engaged against one another and support the second structure member 59 atop of the first structure member 51. The structure members 51, 59 will usually have at least two latch mechanisms 50 spaced from each other along the flanges 55, 63. The pilots 68P position the structure members 51, 59 so that they cannot slide with respect to each other.

The latch 10 is then closed to secure the structure members 51, 59 to each other. As seen in FIG. 2, the latch 10 is rotated clockwise about the pin 67 and into the position shown in FIG. 5. As the latch 10 is rotated towards the closed position, the latching slot lower cam 17 firstly engages the first structure flange edge 56 and guides the latch so that the flange 24 on the handle end 23 goes under the flange 55. The user of the latch 10 is closing the latch by manually grasping the handle 23H and pushing on the latch 10. As the latch 10 continues to close, the second or upper cam 18 will then engage the edge 64 of the second structure member 59 and begin to cammingly clamp the flanges 55, 63 together. When the latch 10 is rotated completely to the closed position as shown in FIGS. 4 and 5, the flanges 55, 63 are in between the upper and lower clamp surfaces 15, 16 of the latching slot 12 and are positively held together. The latch 10 is held in the closed position by the friction between itself and the flanges 55, 63. The latch 10 can be rendered unopenable by placing a lock 71 through the otherwise unused journal 25 and apertures 54, 62.

To release the structure members 51, 59 from each other, the latch handle 23H is manually grasped and pulled out and the latch 10 rotates outwardly to the position shown in FIGS. 2 and 3 and the structure members 51, 59 may then be removed from each other.

FIG. 6 shows the latch 10 being mounted for rotation in an opposite direction. Specifically whereas the structure shown in FIGS. 1, 2, 3, 4 and 5 would be on the left side of a cabinet box so that the latch 10 is concealed inside of the box, the structure of FIG. 6 would be on the right side of a cabinet box so that the latch 10 is also concealed inside of the cabinet. The latch 10 is absolutely identical but the pin 67 has been placed in the other journal 25 and side extension 26 now becomes the handle 26H. By virtue of this assembly, the pivot point of the latch 10 can be kept to the rear of a cabinet and the manually graspable handle, be it 23H or 26H, always faces toward the front or direction of access, is most easily reached and least liable to be a finger-pincher, and requires the least force for operation.

Figure 11:
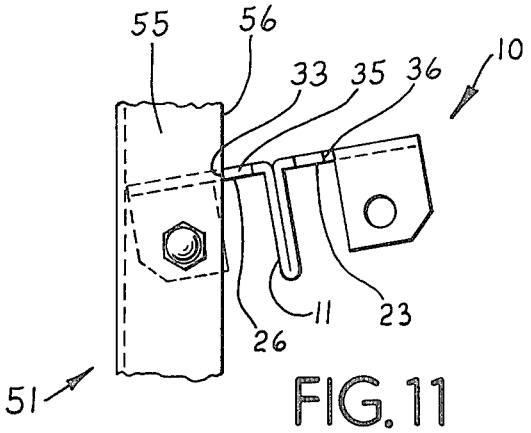
FIG. 11 is a top plan view of the structure of FIG. 3.
Figure 12:
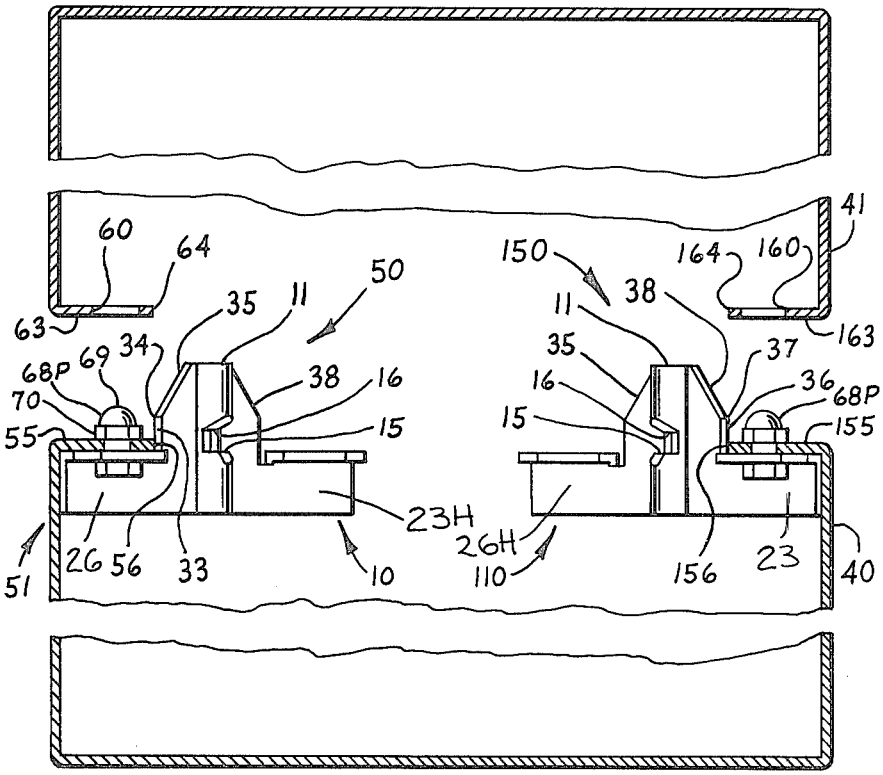
FIG. 12 is a front elevational view in partial section of the structure of FIGS. 5 and 6 in combination with cabinet structure.

FIG. 11 illustrates the latch 10 being unlocked and opened as far as possible. The latch 10 has been opened slightly in excess of ninety degrees CCW rotation with respect to the structure member 51 but is substantially perpendicular to the member 51. As shown in FIG. 11 and FIG. 12, the latch 10 has an opening rotation stop 33 which is abutted against the inner edge 56 of the flange 55. The latch 10 cannot be further opened. As best shown in FIG. 12, the height of the rotation stop 33 is at least twice the thickness of the structure member flange 55 and is greater than the combined thickness of the flanges 55, 63 or the thickness of the latching slot 12 as measured from the lower clamp surface 15 to the upper clamp surface 16. Preferably, the height of the rotation stop 33 is such that its uppermost point 34 is above the fastener wrenching section 70 and about midway along the height of the spherical head 69. There is a guide ramp 35 extending angularly upward from the rotation stop 33 toward the clamping member 11. The preferred angle for the ramp 35 is about thirty degrees inward from vertical.

While both of the rotation stop 33 and the guide ramp 35 are on the side extension 26, the other side extension 23 has an identical opening rotation stop 36 with an uppermost point 37 from which angularly extends another guide ramp 38. These guide ramps 35, 38 and stops 33, 36 are the mirror image of one another and are also symmetrical about the center line of the latch 10 and the clamping member 11.

The function and use of the guide ramps 35, 38 and rotation stops 33, 36 is best shown in FIG. 12 wherein a base 40 and top 41 have the complete latching mechanism 50 on the left side and another latching mechanism 150 on the right side; the other mechanism 150 is the mirror image of mechanism 50 and the other latch 110 is exactly identical to and interchangeable with the latch 10. The left side latch 10 is opened until the stop 33 is abutted against the inner edge 56 of the flange 55 which fixes the guide ramp 35 approximately perpendicular to the flanges 55, 63. The right side latch 110 is opened until the stop 36 abuts the inner edge 156 of the flange 155 which fixes the guide ramp 38 approximately perpendicular to the flange 155, 163. As the top 41 is lowered onto the base 40, the inner edges 64, 164 will contact the guide ramps 35, 38 respectively and the top 41 will be guided into a position atop of the base 40 in which the top 41 is centered with respect to the base 40 and in which the apertures 60, 160 are aligned along the fore/aft axis with the pilot pins 68P, 168P. The top 41 is then moved back and forth until the pilot apertures 60, 160 register along the other axis and the top 41 then drops onto the base 40 and the latches 10, 110 are closed as was previously described.

The latch 10 and mechanism 50 offer many advantages. The latch 10 works to either side and can be journaled to close either clockwise or counter-clockwise without distinction. The latch 10 can be used in any attitude, it maintains itself closed by friction, and it is easily made tamper-proof. The latch mechanism 50 is reasonably strong, very simple and is rattle-free. The weight is minimal, it is easily cleaned, requires no lubrication, and requires no linkage or tools for its operation. It has no loose parts and is completely concealable.

Although other advantages may be found and realized, and various and minor modifications suggested by those versed in the art, be it understood that I wish to embody within the scope of the patent warranted hereon, all such embodiments as reasonably and properly come within the scope of my contribution to the art.

I claim as my invention:

1. A fastener latch for securing first and second structure members to each other, said latch being a single integral piece of sheet metal and comprising:
   (a) a C-shaped clamping member having an open ended latching slot for receiving therein the first and second structure members to be secured together, said clamping members being first and second layers of the sheet metal abutted against and at 180 degrees to each other, each of said layers having substantially the same latching slot therein;
   (b) journal means to one side of the clamping member, for mounting the latch to the first structure member and for rotatably journaling the fastener latch through partial rotation therearound; and
   (c) handle means for rotatable manipulation of the latch around an axis of the journal means.

2. A fastener latch according to claim 1, including a fold line around which the layers are folded 180 degrees, said latching slot having its open end in said fold line.

3. A fastener latch for securing first and second structure members to each other, comprising:
   (a) a C-shaped clamping member having an open ended latching slot for receiving therein the first and second structure members to be secured together;
   (b) journal means to one side of the clamping member, for mounting the latch to the first structure member and for rotatably journaling the fastener latch through partial rotation therearound;
   (c) handle means for rotatable manipulation of the latch around an axis of the journal means;
   (d) a first cam surface in said clamping member for initially engaging the first structure member as the latch is moved toward a fastening position; and
   (e) a second cam surface in said clamping member and opposed to said first cam surface for initially engaging the second structure member as the latch is moved toward a fastening position, with the second cam surface having a lesser angle of attack than the first cam surface.

4. A fastener latch for securing first and second structure members to each other, comprising:
   (a) a C-shaped clamping member having an open ended latching slot for receiving therein the first and second structure members to be secured together;
   (b) journal means to one side of the clamping member, for mounting the latch to the first structure member and for rotatably journaling the fastener latch through partial rotation therearound;
   (c) handle means for rotatable manipulation of the latch around an axis of the journal means; and
   (d) a flange positioned perpendicular to said clamping means, said journal means being an aperture in said flange.

5. A fastener latch according to claim 4, in which said flange and journal are positioned to a first side of the clamping member, and including a second such flange and journal positioned on a second side of the clamping member.

6. A fastener latch according to claim 5, in which the latch is substantially symmetrical to either side of the center of the clamping member.

7. A fastener latch according to claim 5, in which the clamping member includes a cam surface for initially engaging the first structure member as the latch is moved toward the fastening position, and in which said flanges are to the rear of the cam surface.

8. A fastener latch according to any of claims 4, 5, 6 or 7 in which the latch has been formed from a continuous width single blank of sheet metal.

9. A fastener latch according to anyone of claims 1, 2, 3 or 4, in which the latch is a contiguous structure formed from a blank of continuous width initially flat sheet metal.

10. A T-shaped fastener latch comprising (a) a clamping member forming a central leg of the T-shape and having a latching slot open to a distal end of the central leg;

(b) a first side extension forming one arm of the T-shape and extending laterally to one side of the clamping member;

(c) journal means mounted to the first side extension, for rotatable mounting of the fastener latch, and (d) a second side extension forming a second arm of the T-shape and extending laterally to a second side of the clamping member, said second side extension forming a handle for manual manipulation of the latch around an axis of the journal.

11. A T-shaped fastener latch according to claim 10, in which the latch is formed of a contiguous piece of initially flat sheet metal, with the clamping member being of sheet metal being folded over upon itself such that the central leg of the T-shape is two thicknesses of such sheet metal.

12. A T-shaped fastener latch according to claim 10, in which said journal is an aperture in a flange extending from the first side arm, said flange lying in a plane perpendicular to the clamping member and parallel to the latching slot.

13. A T-shaped fastener latch according to claim 12, including a similar flange and aperture mounted to the second side arm and being on the second side of the clamping member.

14. A T-shaped fastener latch according to claim 13, in which said latch is symmetrical about the central leg of the T-shape.

15. A fastener latch according to claim 10, including an angular guide ramp for guiding structure members together, said ramp being in between the clamping member and the journal.

16. A fastener latch according to claim 15, including stop means for limiting rotation of the latch and for positioning the guide ramp.

17. A fastener latch according to claim 15, in which said guide ramp is positioned to the one side of the clamping member and in which the latch includes a second such guide ramp on the other side of the clamping member.

18. A fastener latch according to claim 17, in which said guide ramps are symmetrical to each other and about a center of the clamping member.

19. A fastener latch mechanism comprising:

(a) first and second discrete structure members, said members being removably secured to each other and forming apparatus in which the members are combined;

(b) a pilot on one of said members;

(c) positioning means on the other of said structure members, said means registering with and engaging the pilot and positively positioning the structure members with respect to each other; and (d) a fastener latch rotatably mounted to said first structure member and having (1) a C-shaped clamping member having an open ended latching slot receiving therein and clamping together said first and second structure members, and (2) handle means for rotatable manipulation of the latch to an alternate position in which the latching slot releases said first and second structure members from being clamped to each other.

20. A fastener latch mechanism according to claim 19, in which the latch is mounted to the first structure by a pin about which the latch is so rotatable, and in which said pilot is part of said pin.

21. A fastener latch mechanism according to claim 20, in which the pilot is a fastener securing the pin to the first structure member.

22. A fastener latch mechanism according to claim 21, in which the pilot is an acorn nut mounted on an end of pin.

23. A fastener latch mechanism comprising:

(a) first and second discrete structure members, said members being removably secured to each other;

(b) a first pair of apertures in the first of the structure members;

(c) a second pair of apertures in the second of the structure members, said second pair being in registry with said first pair;

(d) a pin mounted in one of the first pair of apertures;

(e) a fastener latch rotatably fastened to the first structure member by said pin, said latch having (1) a C-shaped clamping member having an open ended latching slot receiving therein and clamping together said first and second structure members, (2) a first journal to a first side of the clamping member, said journal being on said pin and having an axis about which the latch is rotatable, (3) handle means on a second side of the clamping member for rotatable manipulation of the latch to an alternate position in which the latch slot releases said first and second structure members from being clamped to each other, and (4) a second journal on said second side of the clamping member, said second journal being in registry with the second of the first pair of apertures.

24. A fastener latch mechanism according to claim 23, in which said pin is interchangeably mountable in the second journal and second of the first pair of apertures, and in which there is a second such handle means on the first side of the clamping member.

25. A fastener latch mechanism according to claim 23, in which said pin has a pilot portion extending into a corresponding one of the second pair of apertures.

26. A fastener latch mechanism according to claim 25, in which said pilot portion is interchangeably mountable into the second of the second pair of apertures.

27. A fastener latch mechanism according to either of claims 25 or 26, in which the pilot portion is a fastener nut on the pin.

28. A fastener latch mechanism according to claim 23, including a lock pin mounted in and through the second of the first pair of apertures and the second journal.

29. A fastener latch mechanism according to either of claims 24, 25 or 26, including a lock pin mounted in and through the second of the first pair of apertures and the second journal, said lock pin being interchangeably mountable in and through the first journal and first of the first pair of apertures.

30. In a fastener latch mechanism, having a base with a pair of flanges thereon; a separable top with a pair of matching flanges thereon, a pair of latches, with there being one latch on each base flange, each latch having a journal by which the latch is rotatably mounted to said base flange, a clamping member having an open ended latching slot facing and clamping together a respective base flange and top flange, and handle means for rotatable manipulation of the latch about an axis of the journal and to an alternate position in which the latching slot releases a respective top flange from a respective base flange, the improvement comprising a guide ramp on the latch and in between the clamping member and the journal for guiding a respective top flange into position with respect to a respective bottom flange, for centering the top on the base by interaction of the guide ramp of each latch against the respective flanges.

31. A fastener latch mechanism according to claim 30, in which each of the latches is symmetrical about a centerline of its clamping member.

32. A fastener latch mechanism, comprising (a) first and second discrete and completely separable structure members, said members being removably secured to each other and forming apparatus in which the members are combined;

(b) pilot means for positively positioning the structure members with respect to each other;

(c) a fastener latch rotatably mounted to said first structure member and having (1) a clamping member having an open ended latching slot receiving therein and clamping together said first and second structure members, and (2) handle means for rotatable manipulation of the latch to an alternate position in which the latching slot releases said first and second structure members from being clamped to each other; and (d) an angular guide ramp on the latch and to one side of the clamping member, for guiding the second structure member into a position respective to the first structure member, in which position the pilot means are aligned along one axis.

33. A fastener latch mechanism according to claim 32, including stop means on said latch for limiting rotation of the latch with respect to said first structure member, and for positioning said guide ramp with respect to said first structure member; said stop means having a height at least equal to the height of the combined thicknesses of said first and second structure members and being abuttable against inner edges of both of said structure members when said latch is in the alternate position.

* * * * *